United States Patent [19]

Foertsch et al.

[11] Patent Number: 4,925,111

[45] Date of Patent: May 15, 1990

[54] FUEL INJECTION VALVE

[75] Inventors: Manfred Foertsch, Oberhaid; Waldemar Hans, Bamberg, both of Fed. Rep. of Germany; Volker Warnicke, Summerville, S.C.

[73] Assignee: Robert Bosch GmbH, Stuttgart, Fed. Rep. of Germany

[21] Appl. No.: 304,637

[22] Filed: Feb. 1, 1989

[30] Foreign Application Priority Data

Feb. 25, 1988 [DE] Fed. Rep. of Germany ... 8802464[U]

[51] Int. Cl.[5] ..... F02M 61/00

[52] U.S. Cl. ..... 239/533.12; 239/543; 239/585

[58] Field of Search ..... 239/533.2–533.12, 239/543, 544, 562, 585

[56] References Cited

U.S. PATENT DOCUMENTS

| | | | |
|---|---|---|---|
| 3,705,692 | 12/1972 | Garnier | 239/585 |
| 4,007,880 | 2/1977 | Hans et al. | 239/585 |
| 4,057,190 | 11/1977 | Kiwior et al. | 239/585 |
| 4,060,199 | 11/1977 | Brüne et al. | 239/585 |
| 4,235,375 | 11/1980 | Melotti | 239/585 |
| 4,621,772 | 11/1986 | Blythe et al. | 239/585 |
| 4,646,974 | 3/1987 | Sofianek et al. | 239/585 |
| 4,666,088 | 5/1987 | Krauss et al. | 239/585 |
| 4,753,393 | 6/1988 | Sausner | 239/585 |
| 4,771,948 | 9/1988 | Furukawa et al. | 239/562 |

FOREIGN PATENT DOCUMENTS

| | | | |
|---|---|---|---|
| 459677 | 4/1926 | Fed. Rep. of Germany | 239/533.3 |

*Primary Examiner*—Andres Kashnikow
*Assistant Examiner*—Michael J. Forman
*Attorney, Agent, or Firm*—Edwin E. Greigg

[57] ABSTRACT

A fuel injection valve for internal combustion engines is proposed which has at least one metering opening provided in the injection end of the fuel injection valve, an intermediate space formed downstream of the metering opening and defined on its side remote from the metering opening by a preparation wall, which is embodied as thin-walled at least in the vicinity of preparation openings that penetrate it and lead outward from the intermediate space, there further being included an exchangable cap which fits over and is snapped onto the injection end of the nozzle, the preparation openings in the cap which fits over and is snapped onto the injection end of the nozzle, the preparation openings in the cap being contructed to direct fuel at a single intake valve or a pair of intake valves.

10 Claims, 1 Drawing Sheet

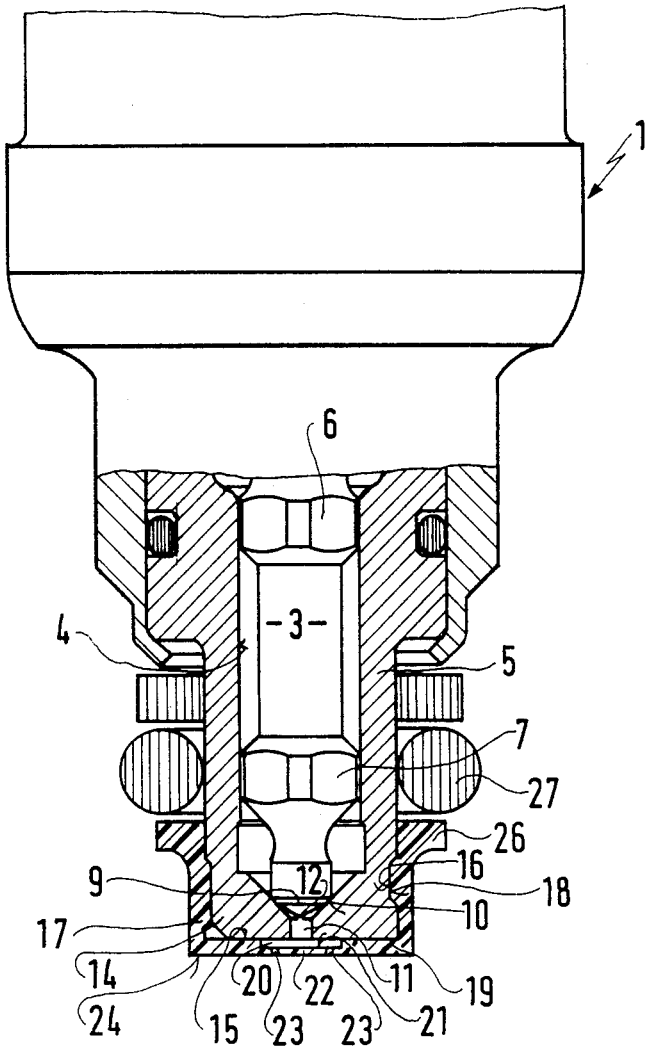
1
6
-3-
4
5
7
27
26
16
18
9
12
10
17
14
24
15
20
23
22
23
11
21
19

FUEL INJECTION VALVE

BACKGROUND OF THE INVENTION

The invention is based on a fuel injection valve as generically defined hereinafter. A fuel injection valve is already known (German Offenlegungsschrift 27 23 280) in which a preparation wall having preparation openings is provided downstream of a metering opening and an intermediate space. The preparation wall is embodied as a thin disk, which is retained in its position by axial bracing between a valve seat body and a nozzle, so that once assembled, it cannot be removed and replaced without destroying this connection. Embodying this disk-shaped preparation wall of plastic is inappropriate in this construction, because the fuel causes undesirable swelling, which impairs the connection. In addition to the preparation wall, the known fuel injection valve is provided with a plastic cap, which fits over the injection end of the fuel injection valve and is retained on it by a detent connection. This cap serves not only to protect the valve from contact, but also to avoid undesirable carbonization, caused by the atmosphere of the engine intake tube that surrounds the injection end of the fuel injection valve, at this end.

OBJECT AND SUMMARY OF THE INVENTION

The fuel injection valve according to the invention has the advantage over the prior art that with only a single part, it provides a simple and economical way of assuring both very good fuel preparation and contact protection and protection from deposits from the intake tube atmosphere. The cap used in the invention has the preparation wall as part of it, so that the cap can easily be removed and replaced and is also easily adapted to various types of fuel injection valves and to the requirements of the engine.

The application discloses other advantages and embodiments of the fuel injection valve as will become clear from a perusal thereof. A particularly advantageous feature is the manufacture of the cap from plastic.

It is also advantageous to embody the intermediate space by means of an indentation in the bottom of the cap.

The invention will be better understood and further objects and advantages thereof will become more apparent from the ensuing detailed description of a preferred embodiment taken in conjunction with the drawing.

BRIEF DESCRIPTION OF THE DRAWING

The figure shows a portion of fuel injection valve with the nozzle housing and the inventive concept shown in cross-section.

DESCRIPTION OF THE PREFERRED EMBODIMENT

The fuel injection valve shown in the drawing is preferably used to supply fuel to the intake tube of mixture-compressing internal combustion engines having externally supplied ignition. If it is electromagnetically actuated, the fuel injection valve 1 has an electrically triggerable magnet circuit, not shown, by which a valve needle 3 connected to an armature of the magnet circuit is actuatable. The valve needle 3 slides in the axial direction in a guide bore 4 of a nozzle body 5. To guide the valve needle 3 inside the guide bore 4, two spaced-apart guide sections 6 and 7 are provided on the valve needle 3, which for example may be embodied as a square bar that enables an axial flow around it. Downstream of the guide section 7, a sealing seat 9 is embodied on the valve needle 3; when the fuel injection valve 1 is closed, this sealing seat rests on a conical valve seat face 10, which is open toward the guide bore 4, of the nozzle body 5. When the fuel injection valve is open, the valve needle 3 and its sealing seat 9 lifts up from the valve seat face 10 of the nozzle body 5; as a result, fuel can flow out of the guide bore 4 via the valve seat face 10 into an adjoining metering opening 11 in the nozzle body 5. The valve needle 3 may, as shown, have a conical needle tip 12 terminating upstream of the metering opening 11. The needle tip 12 may also be provided with a tang, however, which in a manner not shown protrudes into the metering opening 11, so that the fuel metering is effected in a known manner through an annular conduit, which is formed between the circumference of the tang and the wall of the metering opening 11.

The valve seat face 10 and the metering opening 11 are provided on the injection end 14 of the fuel injection valve 1, in the circumference of which, spaced axially apart from an end face 15 of the injection end 14, a detent groove 16 is embodied. A cup-shaped cap 17 is slipped onto the injection end 14 and with an annular detent protrusion 18, for instance, the cap engages the detent groove 16 and is pressed with its bottom 19 axially and firmly against the end face 15. An intermediate space 20 formed by an indentation 21 is provided in the bottom 19 oriented toward the end face 15; the indentation extends radially outward from the metering opening 11, defined axially on one end by the end face 15 and on the other by a preparation wall 22 in the bottom 19. The preparation wall 22 is thin-walled or in other words is embodied like a thin disk and has at least two preparation openings 23 extending from the indentation 21, which together with the end face 15 forms an intermediate space, to the bottom end face 24, which is remote from the end face 15 of the injection end 14. The at least two preparation openings 23 each extend in a direction which is inclined toward one another such that the fuel streams emerging from each of the openings when the injection valve is open strike one another and break up into fuel droplets. The resultant shape of the stream of injected fuel is advantageously conical, optionally hollow- conical. A further possibility is to incline the at least two preparation openings 23 such that the individual streams are aimed via the individual intake tubes at the inlet valves of various cylinders of the engine, or in another embodiment having an exchangable cap at two separate inlet valves of so-called four-valve engines. As a rule the preparation openings 23 are circular in cross section, but they may have some other shape instead.

To avoid undesirable twisting of the cap 17 and a resultant change in the stream direction, twist prevention is for instance attainable by providing that the detent groove 16 is guided in a narrow zone, as shown on the left in the drawing, as far as the end face 15, and the detent protrusion 18 of the cap 17 is likewise axially extended accordingly, engaging this longitudinally extending groove.

Remote from the bottom 19, the cap 17 is provided on its other end with an outwardly extending collar 26, which acts as a stop face for a sealing ring 27, which encompasses the fuel injection valve in the vicinity of the injection end 14 and serves to seal off the valve from the outside if the fuel injection valve is installed so that it is arranged to extend into the intake tube.

Advantageously, the cap 17 is embodied of an elastic material, for instance being a plastic injection molded part. Because the cap 17 is easily attached by the snap-in engagement of the detent connection 16, 18, the cap 17 can be replaced rapidly at any time, which among other effects makes it possible to vary the shape of the injected fuel stream quickly and easily and thus to adapt to a particular type of fuel injection valve or to the requirements of a particular engine.

The foregoing relates to a preferred embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines comprising a nozzle body (5), said nozzle body including a fuel injection end (14), said fuel injection end having an am and a downstream surface, a valve seat face (10) on said upstream surface of said fuel injection end, at least one metering opening (11) provided through said fuel injection end (14) of the fuel injection valve, a cup-shaped cap (17) secured onto said fuel injection end, an intermediate space (20) formed downstream of the metering opening between said fuel injection end downstream surface and said cup-shaped cup an defined on a side remote from said at least one metering opening by a preparation wall (22) which is embodied as thin-walled, at least two preparation openings (23) that penetrate said preparation wall and lead outward from said intermediate space, said cup-shaped cap fits over and snaps onto said fuel injection end, and said preparation wall is embodiment in a bottom (19) of said cup-shaped cap.

2. A fuel injection valve as defined by claim 1, in which said cup-shaped cap (17) rests with its bottom (19) on an end face (15) of said fuel injection end (14), and said intermediate space (20) is defines by an indentation (21) in the bottom (19) of said cup-shaped cap and by said end face (15) of the injection end (14).

3. A fuel injection valve as defined by claim 2, in which said at least two preparation openings (23) extend in a direction which is inclined toward one another such that a fuel stream emerging from each of said preparation openings strike one another and break apart into fuel droplets.

4. A fuel injection valve as defined by claim 3, in which said at least two preparation openings (23) extend in a direction which is relative to one another such that at least two fuel streams are produced.

5. A fuel injection valve as defined by claim 4, in which said cup shaped cap (17) is made of plastic.

6. A fuel injection valve as defined by claim 3, in which said cup shaped cap (17) is made of plastic.

7. A fuel injection valve as defined by claim 2, in which said at least two preparation openings (23) extend in a direction which is relative to one another such that at least two fuel streams are produced.

8. A fuel injection valve as defined by claim 7, in which said cup shaped cap (17) is made of plastic.

9. A fuel injection valve as defined by claim 2, in which said cup shaped cap (17) is made of plastic.

10. A fuel injection valve as defined by claim 1, in which said cup shaped cap (17) is made of plastic.

* * * * *